United States Patent [19]

McCown et al.

[11] 4,041,872

[45] Aug. 16, 1977

[54] WRAPPER, STRUCTURAL SHIELDING DEVICE

[75] Inventors: Thomas E. McCown, Los Angeles; Ken A. McClymonds, Woodland Hills; Robert W. Halprin, Los Angeles, all of Calif.

[73] Assignee: The United States of America as represented by the Secretary of the Army, Washington, D.C.

[21] Appl. No.: 179,531

[22] Filed: Sept. 10, 1971

[51] Int. Cl.[2] ..... F42B 13/00

[52] U.S. Cl. ..... 102/105

[58] Field of Search ..... 244/117, 1 SS; 102/105; 156/169; 29/182.1

[56] References Cited

U.S. PATENT DOCUMENTS

| | | | |
|---|---|---|---|
| 3,001,473 | 9/1961 | Shepheard | 102/105 |
| 3,130,940 | 4/1964 | Erb et al. | 102/105 |
| 3,270,503 | 9/1966 | Meyer, Jr. | 102/105 X |
| 3,454,372 | 7/1969 | Schwarzkopf et al. | 102/105 |

*Primary Examiner*—Verlin R. Pendegrass
*Attorney, Agent, or Firm*—William G. Gapcynski; Lawrence A. Neureither; James T. Deaton

[57] ABSTRACT

A shield for shielding against radiation from a nuclear blast. The shield is comprised of an aluminum body structure, a tin sheet bonded to the outer surface of the aluminum body structure, a glass filament reinforced epoxy resin matrix composite plastic material wrapped about the tin material and an outer layer of external thermal ablative insulation. The glass filament wrapping of the tin material causes the tin material to act as an effective shielding material by maintaining integrity of the tin when exposed to radiation.

4 Claims, 3 Drawing Figures

Thomas E. McCown
Ken A. McClymonds
Robert W. Haltrin,
INVENTORS.

BY Jack W. Voigt
James T. Deaton

WRAPPER, STRUCTURAL SHIELDING DEVICE

BACKGROUND OF THE INVENTION

In high performance long range missiles, there is especially a need for shielding such components of a missile as the warhead section and the guidance section. Also, the shield should be low in cost and light in weight.

Therefore, it is an object of this invention to provide a shielding device that is relatively low in cost and light in weight.

Another object of this invention is to provide a novel shielding device in which the tin material is prevented from spallation by using an overwrap reinforcement to contain the spallation of the tin material.

Still another object of this invention is to provide a shielding device that is capable of withstanding 500 taps per exposure and to withstand multiple exposures (Which are not directly additive) of as much as 1,000 taps.

SUMMARY OF THE INVENTION

In accordance with this invention, a shielding device is provided that includes an aluminum shell structure upon which tin sheet is bonded to the outer surface of the aluminum shell structure. Overwrapped upon and bonded to the tin, is a glass filament reinforced epoxy resin matrix composite plastic material which is tape wrapped on and in a layer construction. Over the epoxy glass tape overwrap is sprayed an external ablative insulation. Spallation of the tin, due to high tensile stresses caused by nuclear environment, will be contained by the fiberglass overwrap, thus maintaining the integrity of the tin as a shielding material.

DETAIL DESCRIPTION OF THE INVENTION

Figure 1:
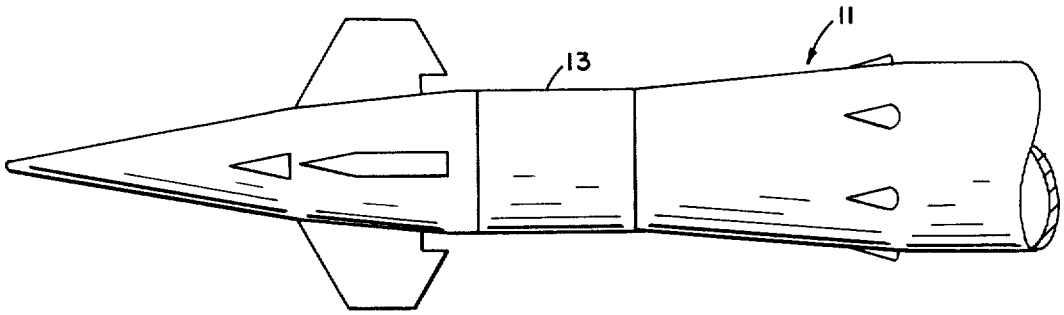
FIG. 1 is a perspective view of a portion of a missle containing the shielding device according to this invention.
Figure 2:
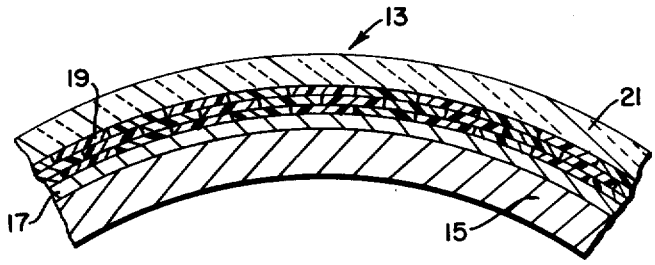
FIG. 2 is an enlarged partial sectional view illustrating layers of the several materials and with the fiberglass layers further enlarged.
Figure 3:
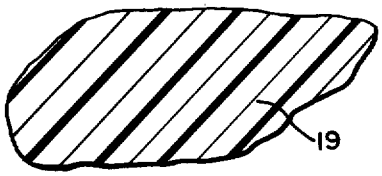
FIG. 3 is a fragmentary view of FIG. 2 with the outer layer of thermal ablative insulation removed to show the diagonal orientation of the fiberglass tape.

Referring now to the drawing, FIG. 1 illustrates a portion of a missle 11 that has a shielding device 13. Shielding device 13, see FIG. 2, includes an inner housing structure 15 which is made of aluminum, a layer of tin 17, a layer of fiberglass overwrap 19, and an outer layer of thermal ablative insulation 21. Tin layer 17 is bonded to aluminum structure 15 by a heat resistant structural adhesive such as FM-123, manufactured by the American Cyanamid Company, Bloomingdale Department, Harve De Grace, Maryland or any heat resistant structural adhesive qualified to the MMM-A-132, Type 1, Class 2 Specification.

In practice, aluminum housing 15 is approximately 0.125 inches thick and tin layer 17 is approximately 0.054 inches thick. After the tin has been bonded to the aluminum housing, overwrap of about 3 or 4 layers of epoxy impregnated glass filament tape in which the glass reinforcement filaments run along the length of the tape are wrapped about the tin layer with a slight lead angle and butting of the edges of the tape. Each layer of tape is wound in a different direction. The comosite material of the epoxy impregnated glass filament tape consists of 26 ± 3 percent resin by weight with a maximum volatile content of 3 percent by weight. On top of the fiberglass layer is placed a layer of thermal insulation such as Sparesyl, which is manufactured to the specification 11244452 by Dyna Therm Chemical Corporation of Los Angeles, California. The thermal insulation Sparesyl is an epoxy resin with a polyamide hardener mixed with the following other constituents, DC 2106 silicon resin, high silica fibers, colloidal pyrogenic silica pigment (Cab-O-Sil), and two subliming salts, one of which is $(NH_4)_2(B_6O_7)$. Subliming salts make up about 22 to about 23 weight percent of the thermal insulation and the silica fibers make up about 4 to about 6 weight percent of the thermal insulation. The remainder is resin and pigment.

The shield device is fabricated as a sequence operation as follows: First, the aluminum structure 15 is cleaned for bonding by degreasing and grit blasting. Second, the heat resistant structural adhesive is applied to the cleaned structure and a tin sheet or sheets are fitted in place about the aluminum structure 15. The assembly is then wrapped with a bleeder cloth, vacuum bagged, placed in an autoclave, and cured at 25 psi pressure with a temperature of 200° to 225° F for three hours. Third, the vacuum bag and bleeder cloth are removed and the exposed surface of the tin is cleaned by degreasing and grit blasting. Fourth, the epoxy resin impregnated glass filament tape layer 19 is wrapped over tin 17 in about three or four layers. The bleeder cloth and vacuum bag are again applied and the overwrap is cured in a similar manner to the curing of the heat resistant structural adhesive. Fifth, the vacuum bag and bleeder cloth are removed and the fiberglass layer 19 is cleaned by lightly sanding. Sixth, the thermal insulation layer 21 is sprayed in place and cured at 125° F for two to four hours and at room temperature for two to six days. If desired, the structure can then be painted.

The shield device according to this invention uses relatively common and inexpensive materials to provide a nuclear radiation shield with the capability of functioning throughout multiple radiation pulses. The outer insulation layer 21 and the fiberglass layer 19 serve to reduce the amount of energy on tin 17. In addition, the high strength fiberglass layer 19 serves to maintain integrity of tin layer 17 and provides shielding for subsequent pulses. The overall composite shield device can be used to protect any vulnerable equipment from radiation effects. That is, it can be used to shield rocket motors, guidance packages, linear charges, and various devices.

We claim:

1. A shielding device comprising a housing structure with a layer of tin mounted thereon, a layer of fiberglass mounted about said tin layer and an outer layer of thermal insulation material mounted on said fiberglass whereby said thermal insulation and said fiberglass serve to maintain integrity of said tin layer when said shield device is subjected to radiation.

2. A shielding device as set forth in claim 1, wherein said housing structure is cylindrical and is made of aluminum, and wherein said tin layer is in sheet form and is bonded by a heat resistant structural adhesive to said housig structure body.

3. A shielding device as set forth in claim 2, wherein said fiberglass is in layers of glass filament that run diagonally about said tin to lend structural support and maintain integrity of said tin.

4. A shielding device as set forth in claim 3, wherein said thermal insulation includes high silica fibers in about 4 to about 6 weight percent of said thermal insulation, and two subliming salts in an amount of about 22 to about 23 weight percent, one of said two subliming salts being $(NH_4)_2(B_6O_7)$, and the remainder of said thermal insulation being comprised of epoxy resin, silicon resin, and colloidal pyrogenic silica pigment.

* * * * *